US007019038B2

(12) United States Patent
Espinoza et al.

(10) Patent No.: US 7,019,038 B2
(45) Date of Patent: Mar. 28, 2006

(54) RECYCLE OF LOW BOILING POINT PRODUCTS TO A FISCHER-TROPSCH REACTOR

(75) Inventors: Rafael L. Espinoza, Ponca City, OK (US); Harold A. Wright, Ponca City, OK (US); Jianping Zhang, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 120 days.

(21) Appl. No.: 10/446,263

(22) Filed: May 23, 2003

(65) Prior Publication Data

US 2004/0235967 A1 Nov. 25, 2004

(51) Int. Cl.
*C07C 27/00* (2006.01)

(52) U.S. Cl. ..... 518/700; 518/705; 518/706; 518/728

(58) Field of Classification Search ..... 518/700, 518/705, 706, 728
See application file for complete search history.

(56) References Cited

U.S. PATENT DOCUMENTS 4,451,679 A 5/1984 Knifton et al.
4,547,525 A 10/1985 Kim
4,754,092 A 6/1988 Iglesia et al.
4,814,538 A 3/1989 Devries et al.
5,118,715 A 6/1992 Iglesia et al.
5,961,933 A 10/1999 Casanave et al.
6,060,524 A 5/2000 Casanave et al.
6,156,809 A 12/2000 Clark et al.
6,331,573 B1 12/2001 Kibby
6,531,515 B1 3/2003 Moore, Jr. et al.
2002/0151605 A1 10/2002 Kibby

OTHER PUBLICATIONS

Gormley, Robert J. et al; *Influence of Liquid Medium on the Activity of a Low-Alpha Fischer-Tropsch Catalyst*; Coal Liquefaction and Gas Conversion Contractors Review Conference Pittsburgh, PA. Aug. 29-31, 1995 (pp. 437-450 (13/14) pp. 3541-3548.

Chou, J. S.; Chao, K. C.; *Correlation of synthesis gas solubility in n-paraffin solvents and Fischer-Tropsch waxes*; Fluid Phase Equilib. (1989) 46(2-3), 179-195.

(Continued)

*Primary Examiner*—J. Parsa
(74) *Attorney, Agent, or Firm*—Conley Rose P.C.

(57) ABSTRACT

Methods for reducing the average molecular weight of liquid hydrocarbons in a Fischer-Tropsch reactor are disclosed. The preferred embodiments of the present invention are characterized by feeding a hydrocarbon stream, which lowers the average molecular weight of the hydrocarbon liquids inside the reactor, and more preferably by recycling a portion of low-molecular weight hydrocarbon products back into the reactor. Lowering the molecular weight of the hydrocarbon liquids inside the reactor increases the mass transfer and solubility, and diffusivity of the reactants in the hydrocarbons present in the slurry.

44 Claims, 2 Drawing Sheets

OTHER PUBLICATIONS

Huang, S. H.; Lin, H.M.; Chao, K. C.; *Experimental investigation of synthesis gas solubility in Fischer-Tropsch reactor slurry*; Fluid Phase Equilib. (1987), 36, 141-148.

Chou, Jeffrey S.; Chao, Kwang Chu; *Solubility of synthesis and product gases in a Fischer-Tropsch SASOL wax*; Ind. Eng. Chem. Res. (1992), 31(2), 621-623.

Huang, Stanley H.; Lin, Ho Mu; Tsai, Fuan Nan; Chao, Kwang Chu; *Solubility of synthesis gases in heavy n-paraffins and Fischer-Tropsch wax*; Ind. Eng. Chem. Res. (1988), 27(1), 162-169.

Chang,M-Y & Morsi, BI; *Solubilities and Mass Transfer coefficients of Carbon Monoxide in a Gas-Inducing Reactor Operating with Organic Liquids Under High Pressures and Temperatures*; (1992) Chem Eng Sci; vol. 47 (13/14) pp. 3541-3548.

Chang,M-Y & Morsi, BI; *Mass Transfer in a Three-Phase Reactor Operating at Elevated Pressures and Temperatures*; (1992) Chem Eng Sci.; vol. 47 (7) pp. 1779-1790.

Brenan & Beenackers; *Thermodynamic Models to Predict gas-Liquid Solubilities in the Methanol Synthesis, the Methanol-Higher Alcohol Synthesis and the Fischer-Tropsch Synthesis via Gas-Slurry Processes*; (1996) Ind. Eng. Chem. Res.; vol. 35, pp. 3763-3775.

Albal, RS; Shah, YT; Carr, NL; & Bell, AT; *Mass Transfer Coefficients and Solubilities for Hydrogen and Carbon Monoxide Under Fischer-Tropsch Conditions*; (1984) Chem Eng Sci vol. 39 (No. 5) pp. 905-907.

Chao, K.C. & Lin, H.M.; *Synthesis Gas Solubility in Fischer-Tropsch Slurry; Final Report*; DOE/PC/70024-T9; (1988) School of Chem. Eng., Purdue Univ., Lafayette, IN; (pp. 152).

RECYCLE OF LOW BOILING POINT PRODUCTS TO A FISCHER-TROPSCH REACTOR

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates generally to Fischer-Tropsch slurries and more particularly to methods and apparatus for reducing the average molecular weight of liquid hydrocarbons in a Fischer-Tropsch reactor.

BACKGROUND OF THE INVENTION

Natural gas, found in deposits in the earth, is an abundant energy resource. For example, natural gas commonly serves as a fuel for heating, cooking, and power generation, among other things. The process of obtaining natural gas from an earth formation typically includes drilling a well into the formation. Many wells that provide natural gas are remote from locations with a demand for the consumption of the natural gas, creating the need to transport the gas large distances from the wellhead to commercial destinations. Because the volume of an amount of gas is so much greater than the volume of the same number of gas molecules in a liquefied state, the process of transporting natural gas often includes chilling and/or pressurizing the natural gas in order to liquefy it. However, liquefaction contributes to the final cost of the natural gas.

Thus, there has been interest in developing technologies for converting natural gas to more readily transportable liquid fuels, i.e. to fuels that are liquid at standard temperatures and pressures. One method for converting natural gas to liquid fuels involves two sequential chemical transformations. In the first transformation, natural gas or methane, the major chemical component of natural gas, is reacted with oxygen, or steam, or a combination of both, to form synthesis gas, which is a combination of carbon monoxide and hydrogen. In the second transformation, known as Fischer-Tropsch synthesis, carbon monoxide is reacted with hydrogen to form organic molecules containing carbon and hydrogen. Those molecules containing only carbon and hydrogen are known as hydrocarbons. Those molecules containing oxygen in addition to carbon and hydrogen are known as oxygenates. Hydrocarbons having carbons linked in a straight chain are known as aliphatic hydrocarbons and are particularly desirable as the basis of synthetic diesel fuel.

The Fischer-Tropsch process is commonly facilitated by a catalyst. Catalysts desirably have the function of increasing the rate of a reaction without being consumed by the reaction. Common catalysts for use in the Fischer-Tropsch process contain at least one metal from Groups 8, 9, or 10 of the Periodic Table (in the new IUPAC notation, which is used throughout the present specification). The molecules react to form hydrocarbons while confined on the surface of the catalyst. The hydrocarbon products then desorb from the catalyst and can be collected. H. Schulz (Applied Catalysis A: General 1999, 186, p 3) gives an overview of trends in Fischer-Tropsch catalysis.

The catalyst may be contacted with synthesis gas in a variety of reaction zones that may include one or more reactors. Common reactors include packed bed (also termed fixed bed) reactors and slurry bed reactors. Originally, the Fischer-Tropsch synthesis was carried out in packed bed reactors. These reactors have several drawbacks, such as temperature control, that can be overcome by gas-agitated slurry reactors or slurry bubble column reactors. Gas-agitated multiphase reactors sometimes called "slurry reactors" or "slurry bubble column reactors," operate by suspending catalytic particles in a liquid phase and feeding a gas phase comprising reactants into the bottom of the reactor through a gas distributor, which produces small gas bubbles. As the gas bubbles rise through the reactor, the reactants are absorbed into the liquid and diffuse to the catalyst where, depending on the catalyst system, they are typically converted to gaseous and liquid products. The gaseous products formed enter the gas bubbles and are collected at the top of the reactor. Liquid products are recovered from the suspending liquid by using different techniques like filtration, settling, hydrocyclones, magnetic techniques, etc. Some of the principal advantages of gas-agitated multiphase reactors or slurry bubble column reactors (SBCRS) for the Fischer-Tropsch synthesis, which is exothermic, are the very high heat transfer rates and the ability to remove and add catalyst online. Sie and Krishna (Applied Catalysis A: General 1999, 186, p. 55) give a history of the development of various Fischer Tropsch reactors.

Typically the Fischer-Tropsch product stream contains gas, liquid, and wax hydrocarbon products having a range of number of carbon atoms from 1 to 100 or more, and thus having a range of molecular weights. It is highly desirable to maximize the production of high-value liquid hydrocarbons, such as hydrocarbons with 5 to 20 carbon atoms per hydrocarbon chain ($C_5$–$C_{20}$ hydrocarbons). Throughout the specification $C_{n+}$ denotes hydrocarbons containing at least n hydrocarbons, that is n or more hydrocarbons. These include, for example, wide range naphtha fractions, such as fractions containing $C_5$–$C_{12}$ hydrocarbons, useful for processing to gasoline, and gasoil fractions, such as fractions containing $C_{13}$–$C_{20}$ hydrocarbons, useful for processing to diesel oil. Heavier hydrocarbons in the wax range (e.g. $C_{20+}$) can undergo hydroprocessing treatments to lower their molecular weights to obtain a desirable range of carbon chain length as well as to increase the degree of skeletal isomerization which might be necessary for improving properties of the gasoline and diesel fuels. Lower molecular weight products, such as $C_1$–$C_4$ hydrocarbons, tend to be gaseous at room temperature and are not typically among the desired products.

Typically, in the Fischer-Tropsch synthesis, the distribution of weights that is observed such as for $C_{5+}$ hydrocarbons, can be described by likening the Fischer-Tropsch reaction to a polymerization reaction with an Anderson-Shultz-Flory chain growth probability ($\alpha$) that is independent of the number of carbon atoms in the lengthening molecule. Thus, a range of hydrocarbons from $C_1$ to $C_{21+}$ may be formed, with a selectivity to liquids that depends on the production of gaseous hydrocarbons, as well as on $\alpha$. In particular, the selectivity to liquids in the non-gaseous product is typically characterized by $\alpha$. $\alpha$ is typically interpreted as the ratio of the mole fraction of $C_{n+1}$ product to the mole fraction of $C_n$ product. A value of $\alpha$ of at least 0.72 is preferred for producing high carbon-length hydrocarbons, such as those of diesel fractions and higher molecular weights.

One factor limiting the rate of reaction and selectivity toward the desired higher weight hydrocarbons is the hydrogen ($H_2$) and carbon monoxide (CO) concentrations in the liquid phase. The concentrations of $H_2$ and CO in the liquid phase are dependent on, and may be limited by, the mass transfer coefficient ($k_La$) across the bubbles in the slurry and the solubility of the reactants into the liquid portion of the slurry. Both the mass transfer rate and the solubility are dependent on the molecular weight of the slurry and decrease as the molecular weight of the slurry increases. Therefore, although it may be desirable to produce higher molecular weight hydrocarbons, these hydrocarbons decrease the productivity of the reactor.

Thus, there remains a need in the art for methods and apparatus for reducing the molecular weight of the slurry in order to improve reaction rate, conversion, and reactor production. Therefore, the embodiments of the present invention are directed to methods and apparatus for reducing the molecular weight of a slurry that seek to overcome the limitations of the prior art.

SUMMARY OF THE PREFERRED EMBODIMENTS

Accordingly, there are provided herein methods and apparatus for reducing the average molecular weight of a Fischer-Tropsch slurry. The preferred embodiments of the present invention are characterized by recycling a portion of the hydrocarbon products back into the reactor.

In accordance with one preferred embodiment of the present invention, a method for increasing the mass transfer of a reactant gas component into a liquid product includes feeding a reactant gas to a catalytic reactor; converting at least a portion of the reactant gas on a synthesis catalyst to generate a liquid product having a product average molecular weight; withdrawing from the catalytic reactor a liquid outlet stream comprising at least a portion of the liquid product, the liquid outlet stream having an outlet average molecular weight lower than the product average molecular weight; and feeding to the catalytic reactor a hydrocarbon feedstream with a feed average molecular weight of less than the outlet average molecular weight, such that the difference between the product average molecular weight and the outlet average molecular weight favors a mass transfer increase of at least one component of the reactant gas into the liquid product. In particular, the solubility and/or the diffusivity in the liquid outlet stream of one reactant gas component is at least 1.1 times greater than the solubility and/or the diffusivity in the liquid product of said component. The method may further comprise separating the liquid outlet stream into at least a light stream and a heavy stream. The hydrocarbon feedstream may comprise at least a portion of the light stream, a secondary liquid hydrocarbon source from at least one of the plants selected from the group consisting of a refinery, a gas-to-liquid plant, a polymer production facility and a petrochemical plant, or a combination of both.

In accordance with another preferred embodiment of the present invention, a method for increasing the mass transfer of a reactant gas component into a liquid product includes feeding a reactant gas to a catalytic reactor; converting at least a portion of the reactant gas on a synthesis catalyst to generate a liquid product with a product average molecular weight; withdrawing from the catalytic reactor a liquid outlet stream comprising at least a portion of the liquid product, the liquid outlet stream having an outlet average molecular weight lower than the product average molecular weight; separating the liquid outlet stream into at least a recycling stream and a heavy stream, the recycling stream having an average molecular weight lower than the outlet average molecular weight; and feeding at least a portion of the recycling stream to the catalytic reactor so as to maintain the outlet molecular weight, such that the difference between the product average molecular weight and the outlet average molecular weight favors a mass transfer increase of at least one component of the reactant gas into the liquid product.

In accordance with an alternate preferred embodiment of the present invention, a method for increasing the solubility of synthesis gas into a liquid product includes feeding synthesis gas to a synthesis reactor; converting at least a portion of the synthesis gas to generate a liquid product with a product average molecular weight; withdrawing from the synthesis reactor a liquid outlet stream comprising at least a portion of the liquid product, the liquid stream having an outlet average molecular weight lower than the product average molecular weight; separating the liquid stream into at least a recycling stream and a heavy stream, the recycling stream having an average molecular weight lower than the outlet average molecular weight; and feeding at least a portion of the recycling stream to the synthesis reactor, wherein the ratio of recycling stream flow rate over the liquid outlet stream flow rate is such as to maintain the outlet average molecular weight within a range selected to increase the solubility of at least one component of the synthesis gas into the liquid product.

Another preferred embodiment comprises a process for producing hydrocarbons from synthesis gas, which includes feeding a reactant gas comprising H2 and CO to a hydrocarbon synthesis reactor; feeding a hydrocarbon feedstream with an average molecular weight of less than 300; converting at least a portion of the reactant gas on a hydrocarbon synthesis catalyst to generate a hydrocarbon liquid product stream of an average molecular weight of more than 300; combining the hydrocarbon product stream and the hydrocarbon feedstream within the hydrocarbon synthesis reactor to generate a reactor outlet stream, wherein the flow rate of hydrocarbon feedstream and the rate of conversion are such that the reactor outlet stream has an average molecular weight between 260–350. As can be appreciated, $C_{25}$ has an average molecular weight of about 350.

Still another preferred embodiment comprises a method for producing hydrocarbons which includes removing at least a portion of a slurry comprising hydrocarbons from a catalytic reactor; separating the slurry into a first stream having an average hydrocarbon molecular weight higher than the average hydrocarbon molecular weight of the slurry remaining in the reactor and a second stream having an average hydrocarbon molecular weight lower than the average hydrocarbon molecular weight of the slurry remaining in the reactor; and returning the second stream to the reactor so as to reduce the molecular weight of the average hydrocarbon molecular weight of the slurry in the reactor.

Yet another preferred embodiment comprises a method for decreasing the average molecular weight of the hydrocarbon liquids in a reactor, where the method includes contacting a gaseous reactant with a catalyst in a reactor to produce an intermediate component having an average molecular weight $MW_P$; removing a liquid outlet stream from the reactor, the outlet stream comprising at least a portion of the intermediate component and having an average molecular weight $MW_W$; separating the outlet stream into a recycle stream and a products stream, the recycle stream having an average molecular weight $MW_R$; and feeding at least a portion of the recycle stream into the reactor. $MW_R$ is less than $MW_W$, which is less than $MW_P$.

BRIEF DESCRIPTION OF THE DRAWINGS

For a more detailed understanding of the preferred embodiments, reference is made to the accompanying drawings.

DETAILED DESCRIPTION OF THE PREFERRED EMBODIMENTS

Figure 1:
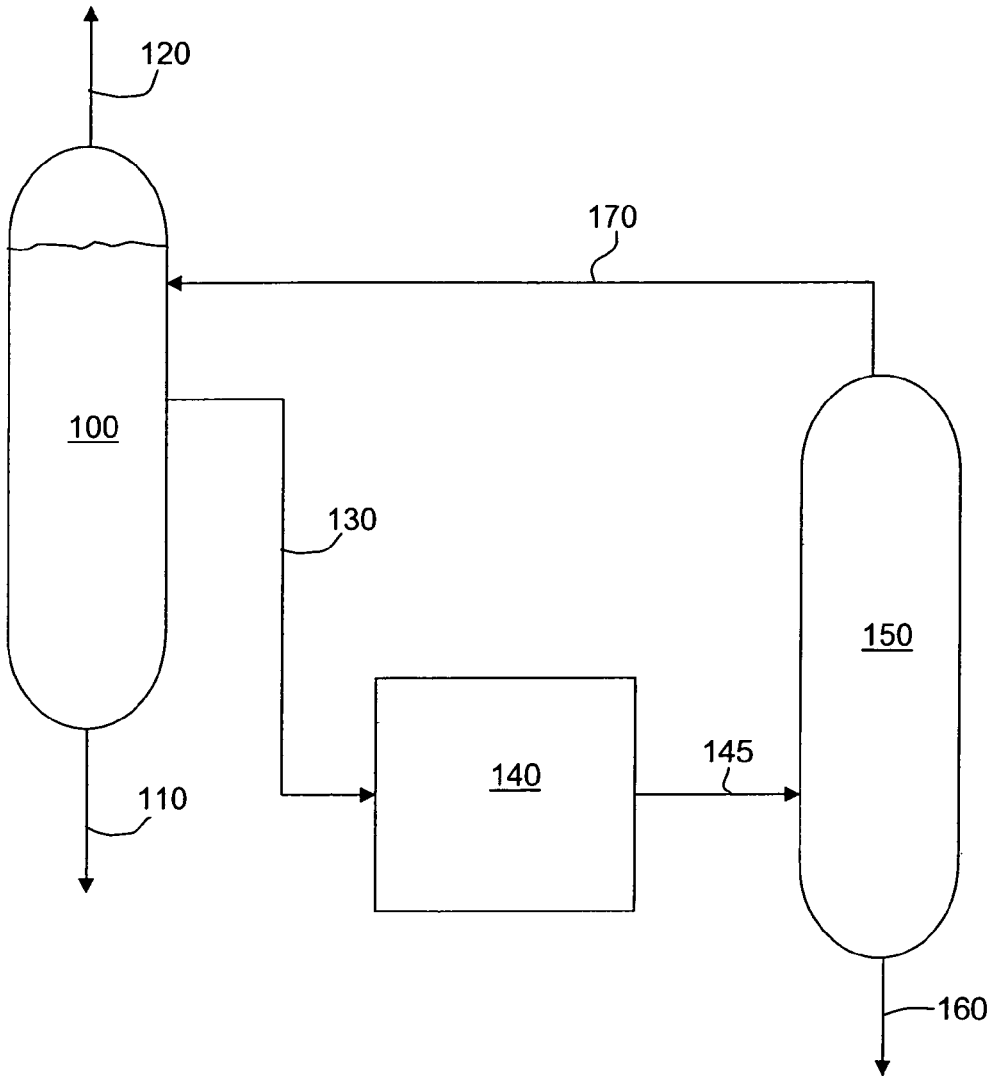
FIG. 1 is a schematic representation of a reactor system having a recycle loop in accordance with one embodiment of the invention.

In the description that follows, like parts are marked throughout the specification and drawing with the same reference numerals, respectively. Certain features of the invention may be exaggerated in scale or in schematic form, and some details of conventional elements may not be shown in the interest of clarity and conciseness.

The preferred embodiments of the present invention relate to methods and apparatus for reducing the molecular weight of the liquid hydrocarbons in a Fischer-Tropsch reactor. The present invention is susceptible to embodiments of different forms. There are shown in the drawing, and described herein in detail, specific embodiments of the present invention with the understanding that the present disclosure is to be considered an exemplification of the principles of the invention, and is not intended to limit the invention to that illustrated and described herein.

In particular, a number of different methods and apparatus for removing hydrocarbon products from a multiphase reactor are also disclosed. Reference is made to a Fischer-Tropsch slurry bubble column reactor but the use of the concepts of the present invention is not limited to the use of a slurry bubble reactor or a Fischer-Tropsch reactor, and may find use in any slurry based catalytic reaction or in a fixed bed Fischer-Tropsch reactor. It is to be fully recognized that the different embodiments and separation techniques discussed below may be employed separately or in any suitable combination to produce desired results.

Referring now to FIG. 1, in one preferred embodiment, a slurry bubble column reactor 100 includes a reactant inlet 110 and a gas outlet 120. Reactor 100 includes a slurry circulation loop that includes a slurry outlet 130, a catalyst-liquid product separation unit 140, a hydrocarbon product fractionator 150, a heavy hydrocarbon stream 160, and a medium hydrocarbon stream 170.

Reactor 100 may be a Fischer-Tropsch reactor containing a catalyst suspended by a gas phase in a liquid phase to form a slurry. Inlet 110 injects syngas into the slurry, where the $H_2$ and CO components of syngas absorb into the slurry and contact the catalyst, initiating a reaction that produces hydrocarbons between $C_2$ and $C_{50}$ or more. The lighter hydrocarbons, depending on the temperature and pressure conditions of reactor 100, will be primarily in gaseous form and will bubble up from the slurry and exit the reactor though gas outlet 120.

The remainder of the hydrocarbon products will mix with the slurry and be circulated out of reactor 100 through outlet 130 that supplies a catalyst-product separation unit 140. Within catalyst-liquid product separation unit 140, a portion of the hydrocarbon products are withdrawn from the slurry as a product stream 145 that is relatively free from catalyst contamination. The slurry exiting the catalyst-liquid product separation unit 140 and comprising a higher concentration of catalyst is recycled into reactor 100 by means of a return line (not shown). The catalyst-liquid product separation unit 140 may utilize filtration, gravitational separation, magnetic separation, supercritical fluid, or any other known process to separate a portion of the liquid products from the catalyst so as to form product stream 145.

Product stream 145 is then fed into fractionator 150, where the products are separated by molecular weight to produce a stream of heavy hydrocarbons 160 and a stream of lighter hydrocarbons 170. Fractionator 150 may employ any method or process to separate the hydrocarbon products and may also be designed to separate the hydrocarbon products along any desired molecular weight or into any number of groups. One preferred fractionator separates hydrocarbons of less than $C_{30}$ into lighter stream 170 and the heavier hydrocarbons into heavy stream 160. Heavy hydrocarbon stream 160 is then exported from the reactor system as a heavy wax product and can be used in further processing. The lighter hydrocarbon stream 170 is preferably recycled back into reactor 100 and mixed with the slurry. Because this lighter hydrocarbon stream 170 contains hydrocarbons with a lower average molecular weight than the molecular weight of hydrocarbons formed in the reactor, the lighter hydrocarbon stream effectively reduces the average molecular weight of the liquid hydrocarbons in the slurry.

The decreased average molecular weight of the slurry increases the mass transfer of the gaseous reactants from the gas bubbles into the liquid slurry. The decreased average molecular weight of the slurry also increases the solubility of the reactants into the slurry. This increased mass transfer and solubility increases the reaction rate, conversion rate, and productivity of the Fischer-Tropsch reaction. The decreased average molecular weight slurry may also increase the selectivity of the reaction to produce higher weight hydrocarbons.

Thus, the preferred embodiments are characterized by mixing a lighter liquid hydrocarbon into the reactor. This lighter hydrocarbon causes the average molecular weight of the slurry in the reactor to decline, thus increasing the solubility of the reactants, which increases the reaction rate, conversion rate, and the productivity of the reactor improves. The reduced molecular weight slurry may also improve the selectivity of the reaction to produce heavy wax products. The light hydrocarbon that is recycled may be obtained by separating the Fisher-Tropsch reactor wax into a light and heavy fraction, with the light fraction being recycled back to the reactor.

Alternative embodiments may use a stream of lower weight hydrocarbons from a secondary source to lower the molecular weight of the slurry. The lower molecular weight hydrocarbon liquids in the reactor increase the reaction rate, conversion rate, and productivity of the Fischer-Tropsch reaction. The secondary source comprising lower molecular weight liquid hydrocarbons may be in storage units at the location of the hydrocarbon synthesis process such as a gas-to-liquid (GTL) plant. The low molecular weight liquid hydrocarbons in these storage tanks can be generated on site and accumulated after production or from another nearby plant. Alternative suitable secondary sources comprising lower molecular weight liquid hydrocarbons may be hydrocarbon stream(s) from any adjacent refinery, a GTL plant, a polymer production facility or a petrochemical plant. Any combination of these streams or sources would fulfill the requirement of a lower molecular weight hydrocarbon stream to be fed to the hydrocarbon synthesis reactor in order to lower the average molecular weight of the liquid hydrocarbons present in the synthesis reactor.

Another embodiment includes a fixed bed reactor having a circulation loop that includes a products outlet, fractionators, products streams, including a heavy hydrocarbon stream, and a medium hydrocarbon stream. The fixed bed reactor set up works similar to the slurry bed reactor set up, however the liquid hydrocarbons stream does not need to be processed by a catalyst-wax separation unit.

The Fischer-Tropsch synthesis of hydrocarbon can use any suitable supported or precipitated catalysts comprising a catalytic metal from Group 8, 9, and 10 of the Periodic Table of the Elements, New Notation, as found in, for example, the CRC Handbook of Chemistry and Physics, 82$^{nd}$ Edition, 2001–2002. The catalyst preferably contains cobalt, iron, nickel, or ruthenium, and more preferably cobalt, iron, or ruthenium as the catalytic metal. For cobalt, the catalyst preferably contains about 5 to 75 wt % cobalt and more preferably from about 10 to about 60 wt % cobalt. For iron, the catalyst preferably contains about 10 to 95 wt % iron, and more preferably from about 15 to about 85 wt % iron. For ruthenium, the catalyst preferably contains about 0.5 to about 10 wt % ruthenium and more preferably from about 1 to about 8 wt % ruthenium. The catalyst may contain additionally one or more promoters comprising a metal selected from Group 1–17. A promoter metal is preferably selected from Group 1 (Li, Na, K), 7 (Re), 8 (Ru, Os), 9 (Co, Rh, Ir), 10 (Ni, Pd, Pt), 11 (Cu, Ag), 13 (B). In some embodiments, it may be desirable to utilize a dual function catalyst.

If a catalyst support is used, preferably the catalyst support comprises unmodified, stabilized or modified alumina, silica, titania, zirconia, or combinations thereof. More preferably the catalyst support comprises stabilized or modified alumina, or silica-alumina. Cobalt catalysts have a high activity and selectivity for the Fischer-Tropsch synthesis, and are preferred. The kinetic expression given by Yates and Satterfield (Energy and Fuels 1991, 5, p. 168) can be used to evaluate the performance of a slurry bed Fischer-Tropsch reactor.

The Fischer-Tropsch reactor comprising a catalyst suitable for hydrocarbon synthesis is charged with a reactant gas comprising a mixture of hydrogen ($H_2$) and carbon monoxide (CO). $H_2$/CO mixtures suitable as a feedstock for conversion to hydrocarbons in the system of this invention can be obtained from light hydrocarbons, such as methane or hydrocarbons comprised in natural gas, by means of steam reforming, auto-thermal reforming, dry reforming, advanced gas heated reforming, partial oxidation, catalytic partial oxidation, or other processes known in the art. Alternatively, the $H_2$/CO mixtures can be obtained from biomass, and/or from coal by gasification. In addition the reactant gases can comprise off-gas recycle from the present or another Fischer-Tropsch process. The hydrogen is preferably provided by free hydrogen, although some Fischer-Tropsch catalysts have sufficient water gas shift activity to convert some water and carbon monoxide to hydrogen and carbon dioxide for use in the Fischer-Tropsch process. It is preferred that the mole ratio of hydrogen to carbon monoxide in the reactant gas be greater than 0.5:1 (e.g., from about 0.67: to 2.5:1), preferably from about 1.4: to about 2.3:1. The reactant gas may also contain carbon dioxide or other compounds that are inert under Fischer-Tropsch reaction conditions, including but not limited to nitrogen, argon, or light hydrocarbons. The reactant gas stream should contains only a low concentration of compounds or elements that have a deleterious effect on the catalyst. The reactant gas may need to be treated to ensure low concentrations of sulfur or nitrogen compounds such as hydrogen sulfide, hydrogen cyanide ammonia and carbonyl sulfides.

The reactant gas is contacted with the catalyst in a reaction zone. Mechanical arrangements of conventional design may be employed as the reaction zone including, for example, fixed bed, fluidized bed, slurry bubble column or ebullating bed reactors, among others. Accordingly, the preferred size and physical form of the catalyst particles may vary depending on the reactor in which they are to be used.

The Fischer-Tropsch process is typically run in a continuous mode. In this mode, the gas hourly space velocity through the reaction zone typically may range from about 50 to about 10,000 $hr^{-1}$, preferably from about 300 $hr^{-1}$ to about 2,000 $hr^{-1}$. The gas hourly space velocity is defined as the volume of reactants per time per reaction zone volume. The volume of reactant gases is at standard conditions of pressure (101 kPa) and temperature (0° C.). The reaction zone volume is defined by the portion of the reaction vessel volume where the reaction takes place and which is occupied by a gaseous phase comprising reactants, products and/or inerts; a liquid phase comprising liquid/wax products and/or other liquids; and a solid phase comprising catalyst. The reaction zone temperature is typically in the range from about 160° C. to about 300° C. Preferably, the reaction zone is operated at conversion promoting conditions at temperatures from about 190° C. to about 260° C. The reaction zone pressure is typically in the range of about 80 psia (552 kPa) to about 1000 psia (6895 kPa), more preferably from 80 psia (552 kPa) to about 800 psia (5515 kPa), and still more preferably, from about 140 psia (965 kPa) to about 750 psia (5170 kPa).

Without further elaboration, it is believed that one skilled in the art can, using the description herein, utilize the present invention to its fullest extent. The following embodiments are to be construed as illustrative, and not as constraining the remainder of the disclosure in any way.

EXAMPLES

The Fischer-Tropsch reaction in slurry bubble column reactors is usually in a reaction-on diffusion competing control regime. Increases in the reaction rate and diffusion rate lead to the increase in the reactor conversion and production rate. Computer modeling is used in order to determine the effect of a decrease in the average molecular weight of the hydrocarbons in the solubilities and diffusivities of gas reactants as well as on the reactor performance.

Figure 2:
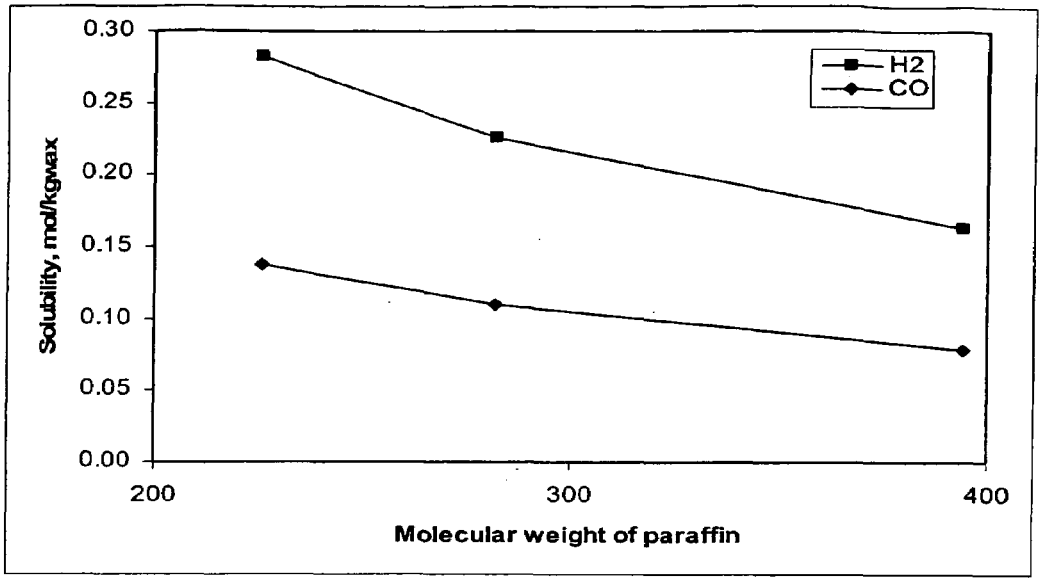
FIG. 2 is a graphic representation illustrating the effect of molecular weight of paraffins on the solubilities of $H_2$ and CO.

The solubilities and diffusivities of gas reactants at different liquid molecular weights were calculated based on the models presented in Chao and Lin (DE88006851, 1988) and Aydin Alkerman (DE88013683, 1988), respectively. FIG. 2 shows the solubilities of hydrogen and carbon monoxide at different molecular weights of paraffins. The paraffin molecular weights selected for this calculation are typically observed during Fischer-Tropsch synthesis conditions and are within the range of the average liquid hydrocarbon molecular weight. As shown in FIG. 2, the $H_2$ and CO solubilities in paraffin decreases as the molecular weight of the paraffin increases. For example the solubilities of $H_2$ and CO at a hydrocarbon molecular weight of 282 (corresponding to n-eicosane or n-C20) are about 1.4 times greater of those obtained with a hydrocarbon molecular weight of 394 (corresponding to n-octacosane or n-C28).

Figure 3:
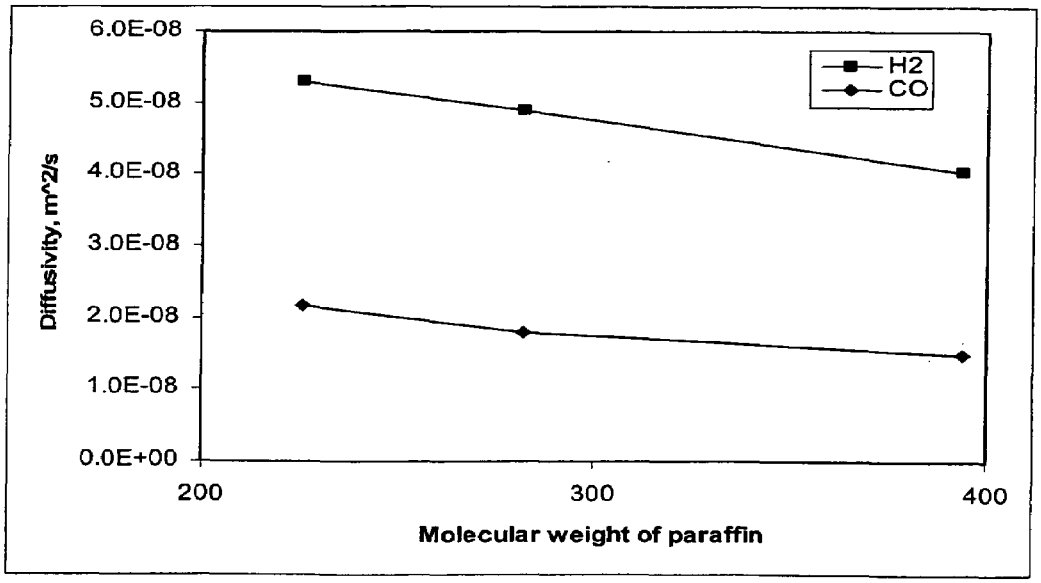
FIG. 3 is a graphic representation illustrating the effect of molecular weight of paraffins on the diffusivity of $H_2$ and CO.

Similarly, FIG. 3 shows the change of the diffusivities of hydrogen and carbon monoxide with various molecular weights of paraffin. As shown in FIG. 3, the $H_2$ and CO diffusivities in a given paraffin decreases as the molecular weight of the paraffin increases. For example the $H_2$ and CO diffusivities at a hydrocarbon molecular weight of 282 (corresponding to n-eicosane or n-C20) are about 1.2 times greater of those obtained with a hydrocarbon molecular weigh of 394 (corresponding to n-octacosane or n-C28). As reported in Krishna and Sie (Design and scale-up of the Fischer-Tropsch bubble column slurry reactor, Fuel Proc. Tech. 64, 2000, 73–105), the mass transfer coefficient is proportional to the square root of the gas diffusivity. Therefore, about 10% increase in the mass transfer coefficient is expected when the liquid hydrocarbon molecular weight in the reactor is changed from 394 (corresponding to n-C28) to 282 (corresponding to n-C20).

Computer modeling was also used to determine the effect of a decrease in the average molecular weight of the hydrocarbons on the reactor performance. The reactor temperature and pressure was 437° F. and 350 psig, respectively. The superficial gas velocity was 25 cm/s and the ASF alpha value ($\alpha$) of the product was 0.927. Table 1 gives the results of reactor performance at typical Fischer-Tropsch conditions when the average molecular weight of liquid hydrocarbons in the reactor were chosen to be 394 (corresponding to n-C28) and 282 (corresponding to n-C20) at two different catalyst activities. For a given catalyst activity, both reactor production rate and CO conversion was greater when the average molecular weight was lower. The increase in reactor production rate and CO conversion was caused by a corresponding increase in the solubility and diffusivity of gaseous reactants as shown in FIGS. 2 and 3 respectively, when the liquid hydrocarbon average molecular weight in the reactor was changed from 394 ($C_{28}$) to 282 ($C_{20}$). The catalyst activity index shown in Table 1 is a factor multiplying the pre-exponential constant of the reaction rate equation and as such, is independent of the reaction temperature or reactants partial pressures. In Table 1, the low activity and high activity catalysts have a catalytic activity index of 1 and 1.5, respectively, thereby meaning that the high activity catalyst is 1.5 times more active than the low activity catalyst. The degree of activity of a catalyst does indeed affect the reactor performance. For a similar conditions of no recycle for example, the CO conversion, production rate and space-time yield are 56.5%, 464 gHC/kg cat/hr, and 89 gHC/lit rxt vol/hr with a low catalyst compared to 65.3%, 537 gHC/kg cat/hr, and 103 gHC/lit rxt vol/hr with a catalyst with has 1.5 times its activity. As shown in Table 1, when the catalyst activity increased, the effect of the changing in the solubility and diffusivity on the reactor performance also increased

TABLE 1

| | Low Catalyst Activity | | High Catalyst Activity | |
|---|---|---|---|---|
| | No recycle | With recycle | No recycle | With recycle |
| Liquid molecular weight in reactor | 394 | 282 | 394 | 282 |
| Catalyst activity index | 1 | 1 | 1.5 | 1.5 |
| CO conversion | 56.5% | 59.0% | 65.3% | 70.1% |
| Production rate, gHC/kgcat/hr | 464 | 484 | 537 | 574 |
| Space-time yield, gHC/lit rxt vol./hr | 89 | 93 | 103 | 111 |

By circulating the light liquid into the reactor, the average liquid hydrocarbon molecular weight in the reactor can be reduced. As discussed above, the average liquid hydrocarbon molecular weight in the reactor is a function of the product distribution, production rate, recycle ratio, and molecular weight of the recycle liquid. The product distribution is defined by the ASF alpha value. The recycle ratio can be determined from the material balance. The derivation is shown in the following paragraphs below.

The overall material balance equation of the reactor with recycling light liquid is given by:

$$P\times MW_P+R\times MW_R=W\times MW_W$$

where P is the molar production rate and $MW_P$ is the average molecular weight of product in liquid; R is the molar flow rate and $MW_R$ is the average molecular weight of the recycle light liquid; W is the molar flow rate and $MW_W$ is the average molecular weight of the liquid withdraw from the reactor. $MW_W$ actually is the average molecular weight of the liquid in the reactor. The average molecular weights of these streams are calculated from the component molar fractions as:

$$MW_P=\Sigma f_{Pi}\times MW_i;\ MW_R=\Sigma f_{Ri}\times MW_i;\ MW_W=\Sigma f_{Wi}\times MW_i$$

where $f_{Pi}$ is the molar fraction of component i in the product in liquid; $f_{Ri}$ is the molar fraction of component i in the recycle light liquid; and $f_{Wi}$ is the molar fraction of component i of the liquid withdraw from the reactor; and $MW_i$ is the molecular weight of component i.

If the recycle ratio is defined as:

$$r=\frac{R}{W}$$

the overall material balance can be written as:

$$P\times MW_P+r\times W\times MW_R=W\times MW_W$$

Another equation governing the recycle ratio is the component material balance equation which is given by:

$$P\times f_{Pi}+r\times W\times f_{Ri}=W\times f_{Wi}$$

Since the flow rate of the recycle light liquid is less than the flow rate of the withdraw liquid, the recycle rate is preferably less than 1. However it is possible to use an accumulation tank (not shown in FIG. 1) which contains a light hydrocarbons source. This tank could comprise light hydrocarbons accumulated from the process or from other processes.

As shown in the material balance equations, the flow rates of the recycle light liquid and the withdraw liquid depend on the compositions of the recycle liquid. Examples of the material balance results are shown in the following tables. Tables 2 and 3 give the results when the reactor product alpha is 0.936. In Table 2, $C_{12}$ and lighter components are recycled and in Table 3, $C_{16}$ and lighter components are recycled. Table 4 gives the results for the reactor product alpha of 0.873 and recycling $C_8$ and lighter components.

TABLE 2

| $MW_P$ | P, lbmol/hr | $MW_R$ | R, lbmol/hr | $MW_W$ | W, lbmol/hr | R |
|---|---|---|---|---|---|---|
| 400.0 | 1013.0 | 104.0 | 456.0 | 330.0 | 1362.0 | 0.335 |
| 400.0 | 1013.0 | 118.7 | 834.0 | 290.0 | 1732.9 | 0.481 |
| 400.0 | 1013.0 | 126.5 | 1358.2 | 255.0 | 2253.9 | 0.603 |
| 400.0 | 1013.0 | 132.8 | 2564.2 | 215.0 | 3457.1 | 0.742 |

TABLE 3

| $MW_P$ | P, lbmol/hr | $MW_R$ | R, lbmol/hr | $MW_W$ | W, lbmol/hr | R |
|---|---|---|---|---|---|---|
| 400.0 | 1013.0 | 147.0 | 569.4 | 325.0 | 1497.9 | 0.380 |
| 400.0 | 1013.0 | 160.0 | 1123.9 | 285.0 | 2042.3 | 0.550 |
| 400.0 | 1013.0 | 168.0 | 2332.1 | 245.0 | 3245.0 | 0.719 |
| 400.0 | 1013.0 | 174.0 | 6943.8 | 205.0 | 7851.5 | 0.884 |

TABLE 4

| $MW_P$ | P, lbmol/hr | $MW_R$ | R, lbmol/hr | $MW_W$ | W, lbmol/hr | R |
|---|---|---|---|---|---|---|
| 274.0 | 1043.6 | 77.2 | 544.0 | 225.2 | 1430.8 | 0.380 |
| 274.0 | 1043.6 | 87.3 | 1025.3 | 194.7 | 1887.9 | 0.543 |
| 274.0 | 1043.6 | 93.7 | 1924.2 | 165.0 | 2765.1 | 0.696 |
| 274.0 | 1043.6 | 98.7 | 6376.5 | 125.5 | 7180.8 | 0.888 |

The average molecular weight of liquid produced in a conventional reactor without recycling light liquids, $MW_P$, ranges from 300 to 450. The average molecular weight of the recycle liquid, $MW_R$, is preferably from 50 to 300. The average molecular weight of liquid in the reactor with recycling light liquid, $MW_W$, is preferably from 100 to 350. Based on these average molecular weights, a preferred recycle ratio ranges from 0.14 to 0.95.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

The invention claimed is:

1. A method for increasing the mass transfer of a reactant gas component into a liquid product comprising:

feeding a reactant gas to a catalytic reactor;

converting at least a portion of the reactant gas on a synthesis catalyst to generate in the catalytic reactor a liquid product having a product average molecular weight;

withdrawing from the catalytic reactor a liquid outlet stream comprising at least a portion of the liquid product, the liquid outlet stream having an outlet average molecular weight lower than the product average molecular weight; and feeding to the catalytic reactor a hydrocarbon feedstream with a feed average molecular weight of less than the outlet average molecular weight, such that the difference between the product average molecular weight and the outlet average molecular weight favors a mass transfer increase of at least one component of the reactant gas into the liquid product inside the catalytic reactor, wherein the ratio of the hydrocarbon feedstream flow rate over the liquid outlet stream flow rate is between 0.14 to 0.95.

2. The method according to claim 1 wherein the reactant gas has a solubility such that the difference between the product average molecular weight and the outlet average molecular weight improves the solubility of at least one component of the reactant gas into the liquid product inside the reactor.

3. The method according to claim 1 wherein the solubility in the liquid outlet stream of one reactant gas component is at least about 1.1 times greater than the solubility of said component in the liquid product inside the reactor.

4. The method according to claim 1 wherein the diffusivity in the liquid outlet stream of one reactant gas component is at least about 1.1 times greater than the diffusivity of said component in liquid product in the reactor.

5. The method according to claim 1 wherein the converting at least a portion of the reactant gas on a synthesis catalyst to generate the liquid product has a reaction rate such that the difference between the product average molecular weight and the outlet average molecular weight improves the reaction rate.

6. The method according to claim 1 wherein the converting at least a portion of the reactant gas on a synthesis catalyst to generate the liquid product has a conversion such that the difference between the product average molecular weight and the outlet average molecular weight favors a higher conversion.

7. The method according to claim 1 wherein the synthesis catalyst is active for the Fischer-Tropsch synthesis.

8. The method according to claim 7 wherein the converting at least a portion of the reactant gas on a synthesis catalyst to generate the liquid product has an $\alpha$ value such that the difference between the product average molecular weight and the outlet average molecular weight favors an increase in the $\alpha$ value.

9. The method according to claim 8 wherein the $\alpha$ value is at least 0.72.

10. The method according to claim 1 wherein the liquid product average molecular weight is from 300 to 450.

11. The method according to claim 1 wherein the outlet average molecular weight is from 260 to 350.

12. The method according to claim 1 wherein the feed average molecular weight is from 150 to 300.

13. The method according to claim 1 wherein the feed average molecular weight is from 77 to 300.

14. The method according to claim 1 wherein the liquid product comprises a Fischer-Tropsch product.

15. The method according to claim 1 further comprising separating the liquid outlet stream into at least a light stream and a heavy stream.

16. The method according to claim 15 wherein the hydrocarbon feedstream comprises at least a portion of the light stream.

17. The method according to claim 15 wherein the light stream is first accumulated into a storage unit before recycling a portion of the light stream to the reactor.

18. The method according to claim 1 wherein the hydrocarbon feedstream comprises a secondary liquid hydrocarbon source from at least one of the plants selected from the group consisting of refinery, gas-to-liquid plant, polymer production facility and petrochemical plant.

19. A method for increasing the mass transfer of a reactant gas component into a liquid product comprising:

feeding a reactant gas to a catalytic reactor;

converting at least a portion of the reactant gas on a synthesis catalyst to generate a liquid product having a product average molecular weight;

withdrawing from the catalytic reactor a liquid outlet stream comprising at least a portion of the liquid product, the liquid outlet stream having an outlet average molecular weight lower than the product average molecular weight;

separating the liquid outlet stream into at least a light stream and a heavy stream; and feeding a recycling stream comprising at least a portion of the light stream to the catalytic reactor at a recycle ratio so as to maintain the outlet molecular weight, such that the difference between the product average molecular weight and the outlet average molecular weight favors a mass transfer increase of at least one component of the reactant gas into the liquid product in the catalytic reactor, wherein the ratio of the recycling stream flow rate over the liquid outlet stream flow rate is between 0.14 and 0.95.

20. The method according to claim 19 wherein the reactant gas has a solubility such that the difference between the product average molecular weight and the outlet average molecular weight improves the solubility of at least one component of the reactant gas into the liquid product in the catalytic reactor.

21. The method according to claim 19 wherein the converting at least a portion of the reactant gas on a synthesis catalyst to generate a liquid product has a reaction rate such that the difference between the product average molecular weight and the outlet average molecular weight improves the reaction rate.

22. The method according to claim 19 wherein the converting at least a portion of the reactant gas on a synthesis catalyst to generate a liquid product has a conversion such that the difference between the product average molecular weight and the outlet average molecular weight favors a higher conversion.

23. The method according to claim 19 wherein the converting at least a portion of the reactant gas on a synthesis catalyst to generate a liquid product has an $\alpha$ value such that the difference between the product average molecular weight and the outlet average molecular weight favors an increase in the $\alpha$ value.

24. The method according to claim 23 wherein the $\alpha$ value is at least 0.72.

25. The method according to claim 19 wherein the liquid product average molecular weight is from 300 to 450.

26. The method according to claim 19 wherein the outlet average molecular weight is from 260 to 350.

27. The method according to claim 19 wherein the recycling stream average molecular weight is from 150 to 300.

28. The method according to claim 19 wherein the recycle ratio is from 0.14 to 0.95.

29. The method according to claim 19 wherein the liquid product comprises a Fischer-Tropsch product.

30. The method according to claim 19 wherein the light stream is first accumulated into a storage unit before recycling a portion of the light stream to the reactor.

31. The method according to claim 19 wherein the recycling stream further comprises a secondary light liquid hydrocarbon source from at least one of the plants selected from the group consisting of refinery, gas-to-liquid plant, polymer production facility and petrochemical plant.

32. A method for increasing the solubility of synthesis gas into a liquid product, comprising:

feeding synthesis gas to a synthesis reactor;

converting at least a portion of the synthesis gas to generate a liquid product with a product average molecular weight;

withdrawing from the synthesis reactor a liquid outlet stream comprising at least a portion of the liquid product, the liquid stream having an outlet average molecular weight lower than the product average molecular weight;

separating the liquid stream into at least a light stream and a heavy stream; and feeding a recycling stream comprising at least a portion of the light stream to the synthesis reactor, wherein the recycling stream has an average molecular weight lower than the outlet average molecular weight, and wherein the ratio of recycling stream flow rate over the liquid stream flow rate is such as to maintain the outlet average molecular weight within a range selected to increase the solubility of at least one component of the synthesis gas into the liquid product in the synthesis reactor, wherein the ratio of the recycling stream flow rate over the liquid outlet stream flow rate is between 0.14 and 0.95.

33. The method according to claim 32 wherein the converting at least a portion of the synthesis gas to generate a liquid product has a reaction rate such that the difference between the product average molecular weight and the outlet average molecular weight favors the reaction rate.

34. The method according to claim 32 wherein the converting at least a portion of the synthesis gas to generate a liquid product has a conversion such that the difference between the product average molecular weight and the outlet average molecular weight favors a higher conversion.

35. The method according to claim 32 wherein the converting at least a portion of the synthesis gas to generate a liquid product has an $\alpha$ value such that the difference between the product average molecular weight and the outlet average molecular weight favors an increase in the $\alpha$ value.

36. The method according to claim 35 wherein the $\alpha$ value is at least 0.72.

37. The method according to claim 32 wherein the product average molecular weight is from 300 to 450.

38. The method according to claim 32 wherein the outlet average molecular weight is from 100 to 350.

39. The method according to claim 32 wherein the recycling average molecular weight is from 50 to 300.

40. A process for producing hydrocarbons from synthesis gas, comprising:

feeding a reactant gas comprising $H_2$ and CO to a hydrocarbon synthesis reactor;

feeding a hydrocarbon feedstream with an average molecular weight between 150 and 300;

converting at least a portion of the reactant gas on a hydrocarbon synthesis catalyst to generate a hydrocarbon product stream of an average molecular weight of more than 300;

combining the hydrocarbon product stream and the hydrocarbon feedstream within the hydrocarbon synthesis reactor to generate a reactor outlet stream, wherein the flow rate of hydrocarbon feedstream and the rate of conversion are such that the reactor outlet stream has an average molecular weight between 100–350.

41. A method for producing hydrocarbons comprising:

providing a slurry comprising a hydrocarbon liquid component inside a catalytic reactor;

removing at least a portion of the slurry comprising hydrocarbons from the catalytic reactor;

separating the at least said portion of the slurry into a first stream having an average hydrocarbon molecular weight higher than the average hydrocarbon molecular weight of the slurry hydrocarbon liquid component remaining in the catalytic reactor and a second stream having an average hydrocarbon molecular weight lower than the average hydrocarbon molecular weight of the slurry hydrocarbon liquid component remaining in the reactor; and returning at least a portion of the second stream to the reactor so as to reduce the molecular weight of the average hydrocarbon molecular weight of the slurry hydrocarbon liquid component in the reactor, wherein the ratio of the flow rate of the returned portion of the second stream to the rate of the liquid withdrawal in the slurry is between 0.14 and 0.95.

42. A method for decreasing the average molecular weight of a liquid component in a reactor, the method comprising:

contacting a gaseous reactant with a catalyst in a reactor to produce an intermediate component having an average molecular weight $MW_P$;

removing a liquid outlet stream from the reactor, the liquid outlet stream comprising at least a portion of the intermediate component and having an average molecular weight $MW_W$;

separating the liquid outlet stream into a recycle stream and a products stream, the recycle stream having an average molecular weight $MW_R$; and feeding at least a portion of the recycle stream into the reactor;

wherein $MW_R < MW_{W\ l\ <MWP}$; wherein the ratio of the recycle stream flow rate over the liquid outlet stream flow rate is between 0.14 and 0.95.

43. The method according to claim 19 wherein the recycling stream has an average molecular weight from 50 to 300.

44. The method according to claim 19 wherein the recycling stream has an average molecular weight from 77 to 174.

* * * * *

UNITED STATES PATENT AND TRADEMARK OFFICE

CERTIFICATE OF CORRECTION

PATENT NO. : 7,019,038 B2
DATED : March 28, 2006
INVENTOR(S) : Rafael L. Espinoza et al.

It is certified that error appears in the above-identified patent and that said Letters Patent is hereby corrected as shown below:

Column 16,
Line 10, "$MW_R < MW_{W\ 1 < MWp}$" should read -- $MW_R < MW_W < MW_p$ --.

Signed and Sealed this

Twenty-third Day of May, 2006

JON W. DUDAS
*Director of the United States Patent and Trademark Office*